US008671474B2

(12) United States Patent
Chepurny

(10) Patent No.: US 8,671,474 B2
(45) Date of Patent: Mar. 18, 2014

(54) SUPPORT FRAME ASSEMBLY FOR PATIENT LIFTS

(75) Inventor: Mark P. Chepurny, Ontario (CA)

(73) Assignee: Prism Medical Ltd., Vaughan, Ontario (CA)

( * ) Notice: Subject to any disclaimer, the term of this patent is extended or adjusted under 35 U.S.C. 154(b) by 65 days.

(21) Appl. No.: 13/258,838

(22) PCT Filed: Mar. 11, 2010

(86) PCT No.: PCT/CA2010/000360

§ 371 (c)(1),
(2), (4) Date: Sep. 22, 2011

(87) PCT Pub. No.: WO2010/108255

PCT Pub. Date: Sep. 30, 2010

(65) Prior Publication Data

US 2012/0011650 A1 Jan. 19, 2012

(30) Foreign Application Priority Data

Mar. 24, 2009 (CA) ..... 2659793

(51) Int. Cl.
*A61G 7/14* (2006.01)

(52) U.S. Cl.
USPC ..... 5/85.1; 5/93.1; 5/81.1 R; 104/126; 104/93; 104/118

(58) Field of Classification Search
USPC ..... 5/83, 87, 81.1 R–81.1 T; 104/126, 93, 104/118; 52/111, 122.1
See application file for complete search history.

(56) References Cited

U.S. PATENT DOCUMENTS

| | | | | |
|---|---|---|---|---|
| 4,944,056 | A | 7/1990 | Schroeder et al. | |
| 6,575,100 | B2 | 6/2003 | Faucher et al. | |
| 8,099,806 | B2 * | 1/2012 | Chepurny et al. | 5/81.1 R |
| 2005/0274572 | A1 | 12/2005 | Stelzer | |
| 2007/0274817 | A1 | 11/2007 | Chepurny et al. | |

FOREIGN PATENT DOCUMENTS

| | | |
|---|---|---|
| EP | 1267791 | 11/2008 |
| WO | 2006032837 A1 | 3/2006 |

* cited by examiner

*Primary Examiner* — Peter M Cuomo
*Assistant Examiner* — Brittany Wilson
(74) *Attorney, Agent, or Firm* — The Webb Law Firm

(57) ABSTRACT

A patient lift support frame assembly, comprising a patient-lift-carrying member, and first and second support members for carrying the patient-lift-support member. The support members are telescopically configured, and can be extended manually, with an actuator to push a ceiling pad against a ceiling for greater stability. The support member are selectively lockable against being shortened, using gears and a cam, or other lock. The ceiling bearing element is spring loaded.

19 Claims, 7 Drawing Sheets

SUPPORT FRAME ASSEMBLY FOR PATIENT LIFTS

FIELD OF THE INVENTION

This invention relates to the field of medical care for the disabled, and in particular, methods and devices for use in providing medical care to the disabled.

BACKGROUND OF THE INVENTION

Patient lift devices are used to lift and move patients who, typically, are to disabled to get up and move about on their own. There are two broad categories of such devices, namely, fixed and portable. A fixed lift is more or less permanently mounted on a track that is, typically, fixed to a ceiling. A strap for lifting and lowering a patient extends from a lift and carries a patient harness. The lift can extend or retract the strap to lower or lift the patient. The lift is also movable along the track. Typically, both the lift/lower function and the movement along the track are motorized, that is, powered by an electric (or other) motor.

Portable lifts may be used either with a fixed track, or with portable support frames that provide overhead tracks. In either case, the portable lift is typically detachably attachable to the track, and can typically be carried by the caregiver to different locations and used in each of those locations. By extending and retracting the strap, the lift can move the patient up and down. The lift is movable along the track. While the movement along the track may or may not be motorized, the lift/lower function is typically motorized. However, portable lifts with manually-powered lifting capability are also known.

Some portable patient lifts are used in association with portable patient lift support frames. The idea is that a caregiver can carry the support frame, together with the lift, from one patient to the next, and from one location to the next, in order to provide necessary care. Because the installation of fixed tracks and lifts can be very expensive, many patients that may be attended to by a caregiver cannot afford such equipment. As such, their needs can be met by the caregiver using a portable patient lift and support frame.

One example of a portable support frame is shown in U.S. published patent application no. 2007/0274817("Chepurny"). The support frame of Chepurny comprises two support legs resting on a floor, with a load support member, comprising a track, running between the support legs. The load support member carries a trolley whose function it is to facilitate the movement of a patient along the track. The trolley is configured to carry the portable patient lift, which patient lift is used to lift and lower the patient.

It will be appreciated that, in the field of portable patient lift support frames, the stability of the support frame is a concern. Specifically, given that the support frame is not fixed to any larger structure, steps need to be taken to ensure that the support frame is sufficiently stable and will not fall over. One approach has been to build support frames that not only rest on the floor, but that press against the ceiling for increased stability. Examples include U.S. Pat. No. 6,575,100 ("Faucher") and U.S. Pat. No. 4,944,056. Faucher discloses a support structure with two legs, and a patient-carrying track running between the two legs. The support legs extend upwardly past the track, and terminate at ceiling plates which press up against the ceiling. Thus, when assembled, the support legs press up against the ceiling and down against the floor to provide stability to the support frame.

The support frame disclosed in Faucher is complicated and cumbersome to use. Specifically, on each support leg, there are two sections in telescopic relation, making the legs height adjustable. The height can be macroscopically adjusted by locking the telescopically-related parts of the leg by means of spring loaded lock protrusions that extend through holes in both parts of the leg that line up with one another. The lock holes are distributed intermittently along the length of the two telescopic portions. To change the lock position, the user must press hard against the spring loading with his fingers, force the protrusions inside the holes, manoeuvre the telescopic portions to a new position while avoiding the locks getting caught in the wrong holes, line up the right holes just so, and re-lock the telescopic portions.

Fine adjustment is also required to ensure that the proper pressure against floor and ceiling is obtained. Thus, the two parts of the leg are also rotationally displaceable relative to one another by means of a screw element. The fine adjustment of the height of the leg is done by rotating the two parts relative to one another, which can take a long time and require substantial energy on the part of the user. Both the macroscopic and fine adjustment mechanisms are awkward, slow and cumbersome to use.

SUMMARY OF THE INVENTION

Therefore, what is desired is a support frame assembly that can be deployed safely, quickly and easily, with the user having sufficient control of the parts so as to lower the risk of injury or damage.

Therefore, according to one aspect of the invention, there is provided a patient lift support frame assembly, comprising:

a patient-lift-carrying member, and first and second support members for carrying said patient-lift-support member, the support members being configured to bear on a floor and support the patient-lift-support member above the floor;

the first support member comprising (1) a first support element and a second support element slidably engaged with one another such that the length of the first support member is adjusted as the first and second support elements slide relative to each other, one of the first and second support elements being positioned as an upper element of the first support member when the patient-lift-support frame is assembled, and the other of the first and second support elements being positioned as a lower element when the patient-lift-support frame is assembled; (2) a driven gear associated with the first support element; (3) a drive gear actuator movably coupled to the second support element and positioned in meshing engagement with the driven gear such that when the actuator is moved, the first and second support elements are urged to slide relative to one another; (4) a lock, movably coupled to the second support element, and engaged with the driven gear, the lock being biased to as to lock against the driven gear to prevent the first and second support elements from sliding so as to shorten the first support member, but configured to permit the first and second support elements to slide so as lengthen the first support member, the lock including an actuator configured to permit the selective unlocking of the lock;

a ceiling bearing element, and a spring member, the spring member being fixed to the upper element, the ceiling bearing element being movably mounted to the spring element such that when the ceiling bearing element is pushed against the ceiling, the first support member can move relative to the ceiling bearing element while continuing to bear on the ceiling.

According to another aspect of the invention, there is provided a patient lift support frame assembly, comprising:

a patient-lift-carrying member, and first and second support members for carrying said patient-lift-support member, the support members being configured to bear on a floor and support the patient-lift-support member above the floor;

the first support member comprising (1) a first support element and a second support element slidably engaged with one another such that the length of the first support member is adjusted as the first and second support elements slide relative to each other, one of the first and second support elements being positioned as an upper element of the first support member when the patient-lift-support frame is assembled, and the other of the first and second support elements being positioned as a lower element when the patient-lift-support frame is assembled; (2) a driven gear associated with the first support element; (3) a drive gear actuator movably coupled to the second support element and positioned in meshing engagement with the driven gear such that when the actuator is moved, the first and second support elements are urged to slide relative to one another; (4) a lock, movably coupled to the one of the first and second support elements, the lock being selectively lockable to hold the actuator in a locked position with the first support member extended, and selectively openable to allow the actuator to move so that the first support member is shortened;

a ceiling bearing element, and a spring member, the spring member being fixed to the upper element, the ceiling bearing element being movably mounted to the spring element such that when the ceiling bearing element is pushed against the ceiling, the first support member can move relative to the ceiling bearing element while continuing to bear on the ceiling.

BRIEF DESCRIPTION OF THE DRAWINGS

Reference will now be made, by way of example only, to drawings of the invention, which illustrate the preferred embodiment thereof, and in which.

DETAILED DESCRIPTION OF THE PREFERRED EMBODIMENTS

Figure 1:
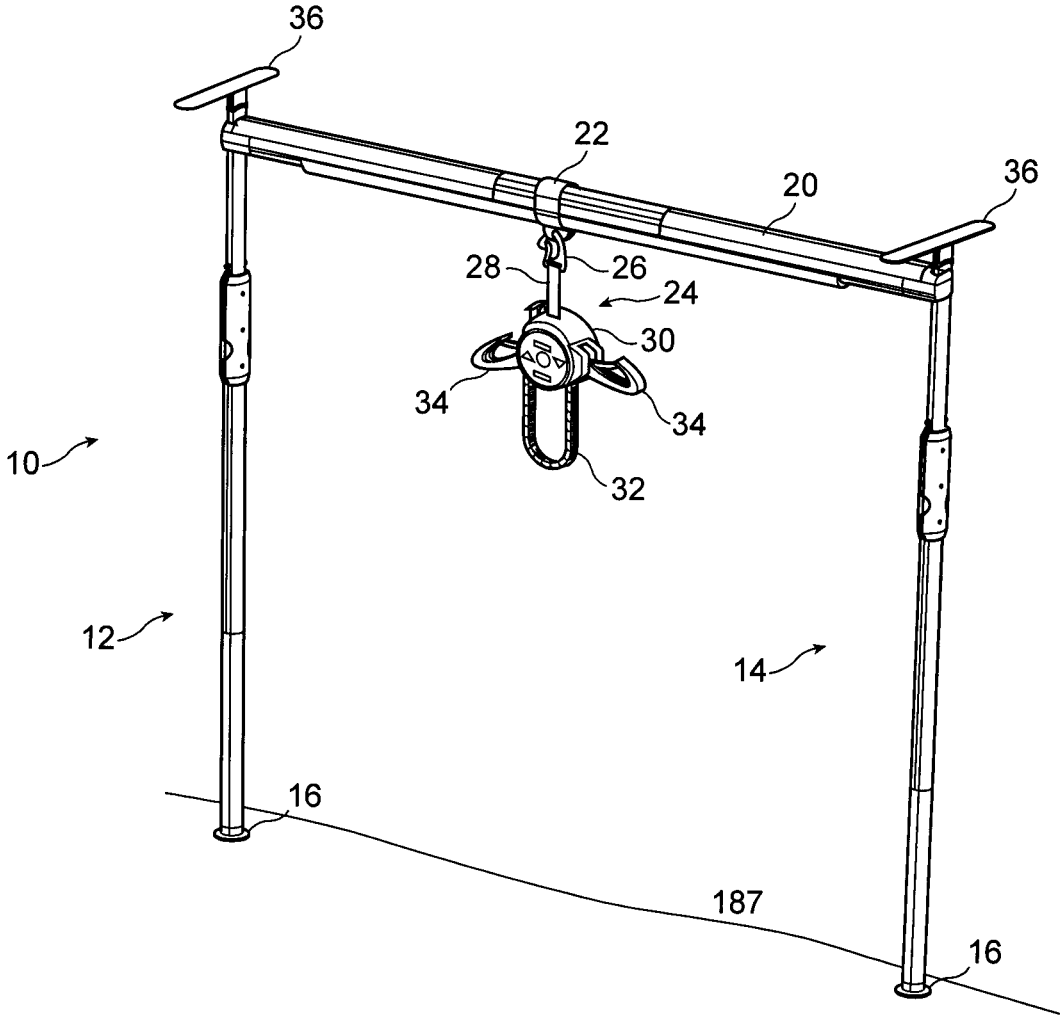
FIG. 1 is a perspective view of the support frame assembly.

Referring now to FIG. 1, a patient lift support frame assembly 10 is shown. The support frame 10 comprises at least first and second support members, preferably in the form of legs 12 and 14. Each is configured to bear on a floor, preferably (but not necessarily) by having floor pads 16 for bearing (due to gravity) on floor 18. Track 20 extends between legs 12 and 14, and is supported by legs 12 and 14. Preferably, track 20 is of variable length, and most preferably, comprises at least two pieces slidable relative to one another, so that a user can lengthen or shorten the track. Carried on the track 20 is a trolley 22, which itself carries a portable lift 24. The portable lift 24 attaches to trolley 22 by means of a safety hook or carabiner 26. The lift 24 further comprises strap 28, lift mechanism 30, lift mechanism actuator 32 (preferably in the form of a chain) and hooks 34 for receiving a patient harness containing a patient. Positioned at the top end of leg 12, and positioned above track 20, is a ceiling bearing portion in the form of pad 36. Another pad 36 is similarly positioned above track 20 at the top end of leg 14. As will be more particularly described below, the frame 10 preferably is deployed in a pressure fit against the floor and ceiling, so that pads 16 push down against the floor, and pads 36 push up against the ceiling, with the result that the stability of frame 10 is improved as compared with a frame that just rests on the floor. Furthermore, this improved stability is preferably achieved without needing to fix the frame to an structure, but simply through pressure against floor and ceiling.

Figure 2:
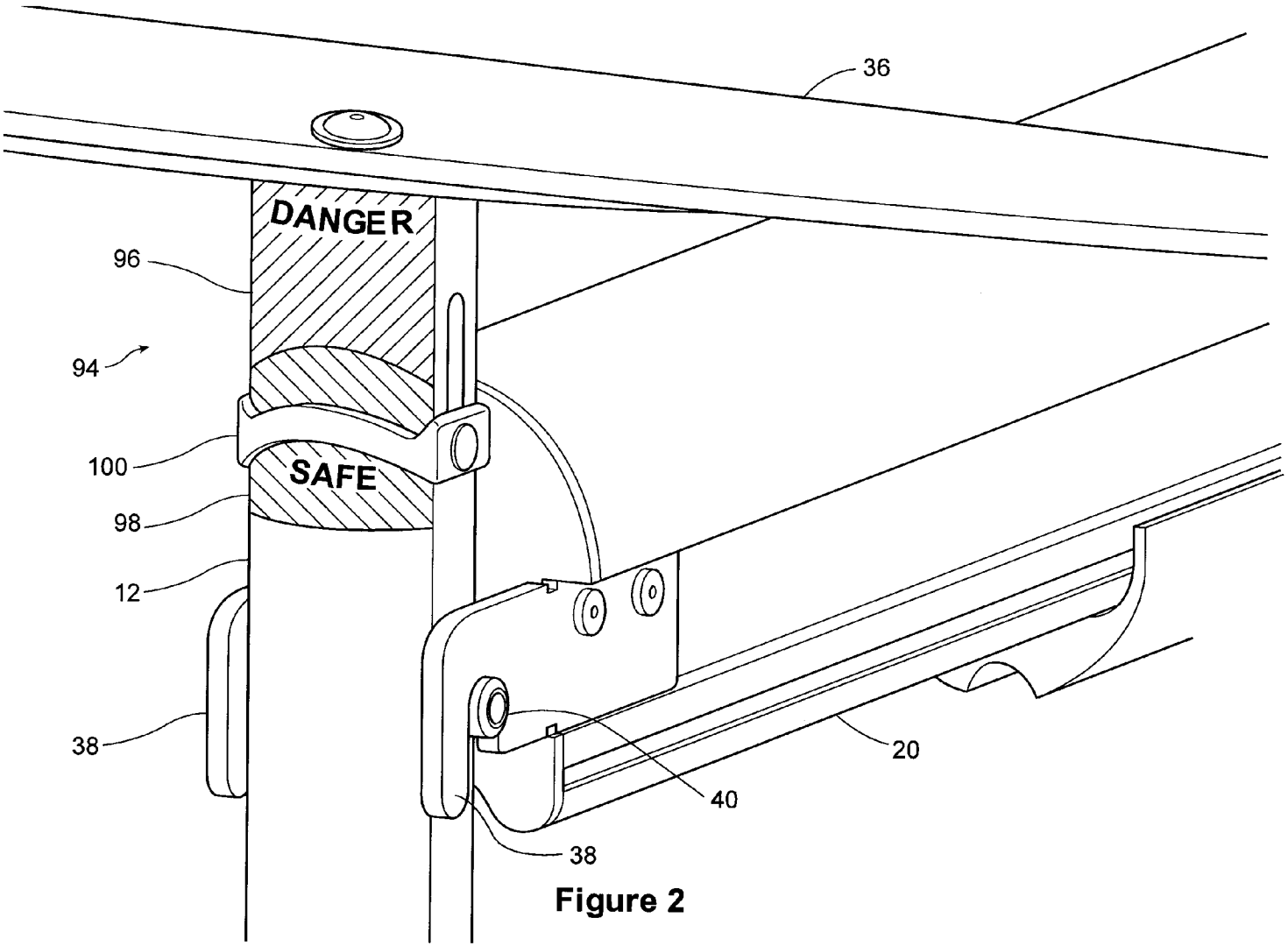
FIG. 2 is a close up view of a support member, track and ceiling bearing element.

FIG. 2 shows a closeup view of the attachment of track 20 to leg 12. Preferably, the same mode of attachment is present between track 20 and leg 14. Preferably, attachment hooks 38 extend from the end of track 20. One hook 38 extends from each side of track 20. Hooks 38 are sized, shaped and positioned to hook securely onto connector lugs 40, which are fixed to leg 12.

Leg 12 extends upward past track 20, and pad 36 is positioned at the top of leg 12. Another pad 36 is similarly positioned at the top of leg 14, which extends upward past the connection point of track 20 to leg 14. Pads 36 are sized, shaped and positioned to bear against the ceiling, as will be described more particularly below.

Figure 3:
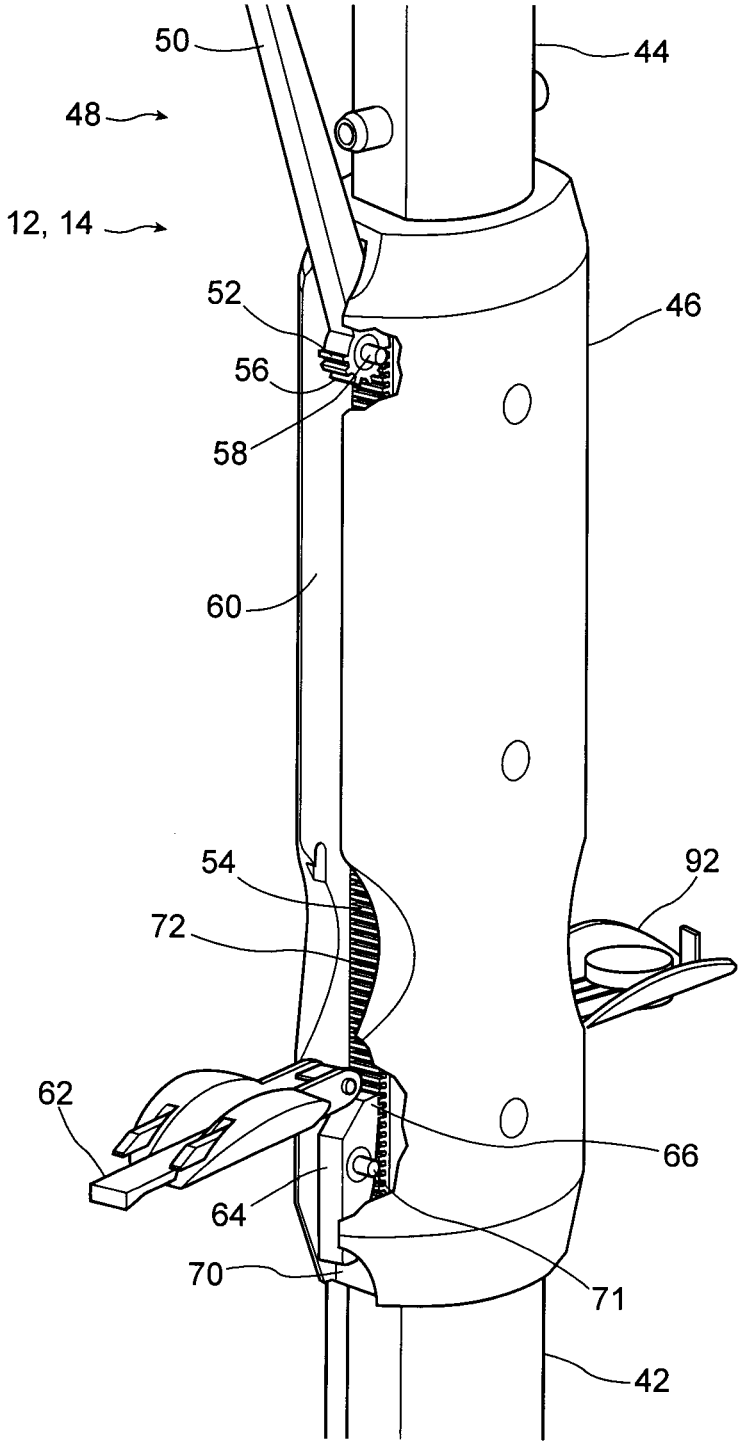
FIG. 3 is a close up view of a portion of the support member.
Figure 4:
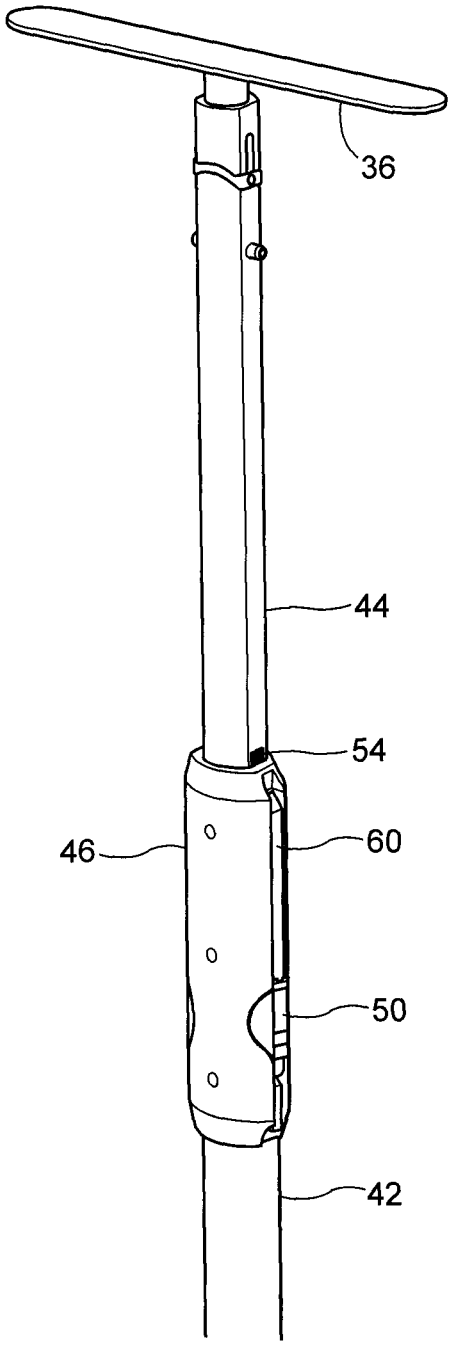
FIG. 4 is a perspective view of a top portion of a support member.

Referring now to FIGS. 3 and 4, each of the legs 12, 14 preferably comprises two support elements, most preferably comprising two shafts slidably engaged with one another in telescopic relation. In the preferred embodiment, the outer, lower, shaft 42 carries floor pad 16, and is located below upper, inner, shaft 44. Preferably, lower shaft 42 has a central channel, and receives upper shaft 44 within that central channel in axial telescopic relation. It will be appreciated, however, that other structures for legs 12,14 are comprehended by the invention. What is important is that at least one of legs 12, 14 comprise two support elements slidable relative to one another such that the leg is length adjustable.

In the preferred embodiment, lower shaft 42 includes a sleeve 46 positioned at its top end. Sleeve 46 carries drive gear actuator 48. Drive gear actuator 48 includes actuator arm 50, which has at its end drive gear 52. Actuator 48 is preferably rotatably or pivotally mounted to sleeve 46, so that when arm 50 is moved, gear 52 rotates.

In the preferred embodiment, the shaft 44 includes a driven gear 54 sized, shaped and positioned to be in meshing engagement with drive gear 52. The driven gear 54 preferably comprises a strip of gear teeth 72 extending along the length shaft 44, so that within the range of length adjustability of the leg, the gears on drive gear 52 can be engaged with the driven gear section 54. Thus, when drive gear 52 is rotated, force is applied to shaft 44 via driven gear 54. In the preferred embodiment, and the embodiment shown in FIG. 3, when arm 50 is moved from an upward pointing position to a downward position, shaft 44 is pushed upward relative to shaft 42.

Actuator 48 has a disengaged position (i.e. disengaged from gear 54), in which gear 52 is disengaged from driven gear section 54, and an engaged position, in which driven gear 52 is in meshing engagement with driven gear section 54. In FIG. 3, the arm 50 and gear 52 are shown in the disengaged position. In this preferred embodiment, the arm 50 is rotated to a position pointing as close to vertically upward as possible, which is the disengaged position. Teeth 56 on gear 52 are sized, shaped and positioned so that no teeth are engaged with gear section 54 when the actuator 48 is in the disengaged position.

In the preferred embodiment, actuator 48 is pivotally mounted on sleeve 46 by means of shaft 58. Teeth 56 on gear 52 are sized, shaped and positioned so that when arm 50 is pivoted downward from the position shown in FIG. 3, teeth 56 engage gear 54, driven gear section 54, and thus shaft 44, upward relative to shaft 42. In the preferred embodiment shown in FIG. 3, the maximum amount of displacement of shaft 44 relative to shaft 42 that can be achieved by movement of arm 50 is achieved when arm 50 is moved to a substantially vertical downward-pointing position within recess 60 of sleeve 46. This maximum displacement position is shown in FIG. 4.

It will be appreciated that, when actuator 48 is in meshing engagement with gear section 54, then shafts 42 and 44 cannot move relative to one another without actuator 48 moving also. The result is that if actuator 48 is locked in place, this provides additional safety, helping to prevent shafts 42 and 44 from moving relative to one another, and thus preventing danger to the patient. Therefore, in the preferred embodiment, arm lock 62 is openably mounted on sleeve 46. In FIG. 3, arm lock 62 is shown in its unlocked position. When arm 50 is moved to its maximum displacement position, arm lock 62 can be closed and locked against sleeve 46, thus blocking access to arm 50. When it is desired to move shafts 44 and 42 relative to one another, lock 62 can be opened, and arm 50 moved to the disengaged position.

The frame preferably further includes a lock, in the form of cam 64, which is preferably moveably coupled to sleeve 46, and most preferably pivotally coupled to sleeve 46. Preferably, the cam 64 is biased so as to be engaged against the driven gear 54. The cam 64, and in particular, the top end 66 of cam 64, together with driven gear 54, are most preferably sized, shaped and positioned so that when cam 64, and in particular, top end 66, are engaged against driven gear 54, shaft 44 cannot move downward relative to shaft 42. The result is that cam 64 is biased so as to lock against driven gear section 54 to prevent shafts 44 and 42 from moving so as to shorten legs 12, 14.

The locking of cam 64 can be disengaged, in the preferred embodiment, pressing against bottom end 68 of the cam 64 in order to pivot top end 66 away from driven gear section 54. The cam 64 is pivotally mounted to sleeve 46 by means of shaft 71 fixed to sleeve 46. Sleeve 46 includes cam access 70 which permits the thumb or finger of a user to access and press against bottom end 68 in order to unlock cam 64 and top end 66 from gear section 54. When cam 64 is locked against gear section 54, the cam, which is carried on shaft 42, is locked against gear section 54, which is carried on shaft 44, thus preventing shaft 44 to move downward into shaft 42. However, the teeth 72 of gear 54, and the top end 66 of cam 64, are sized, shaped and positioned so that shafts 44 and 42 can be moved so as to extend legs 12, 14.

It will be appreciated that the lock described above need not take the form and position of cam 64 to be comprehended by the invention. Other forms of lock are also comprehended. What is important is that the lock be biased to lock against shortening the support leg, be selectively unlockable, and permit the lengthening of the support leg.

Figure 5:
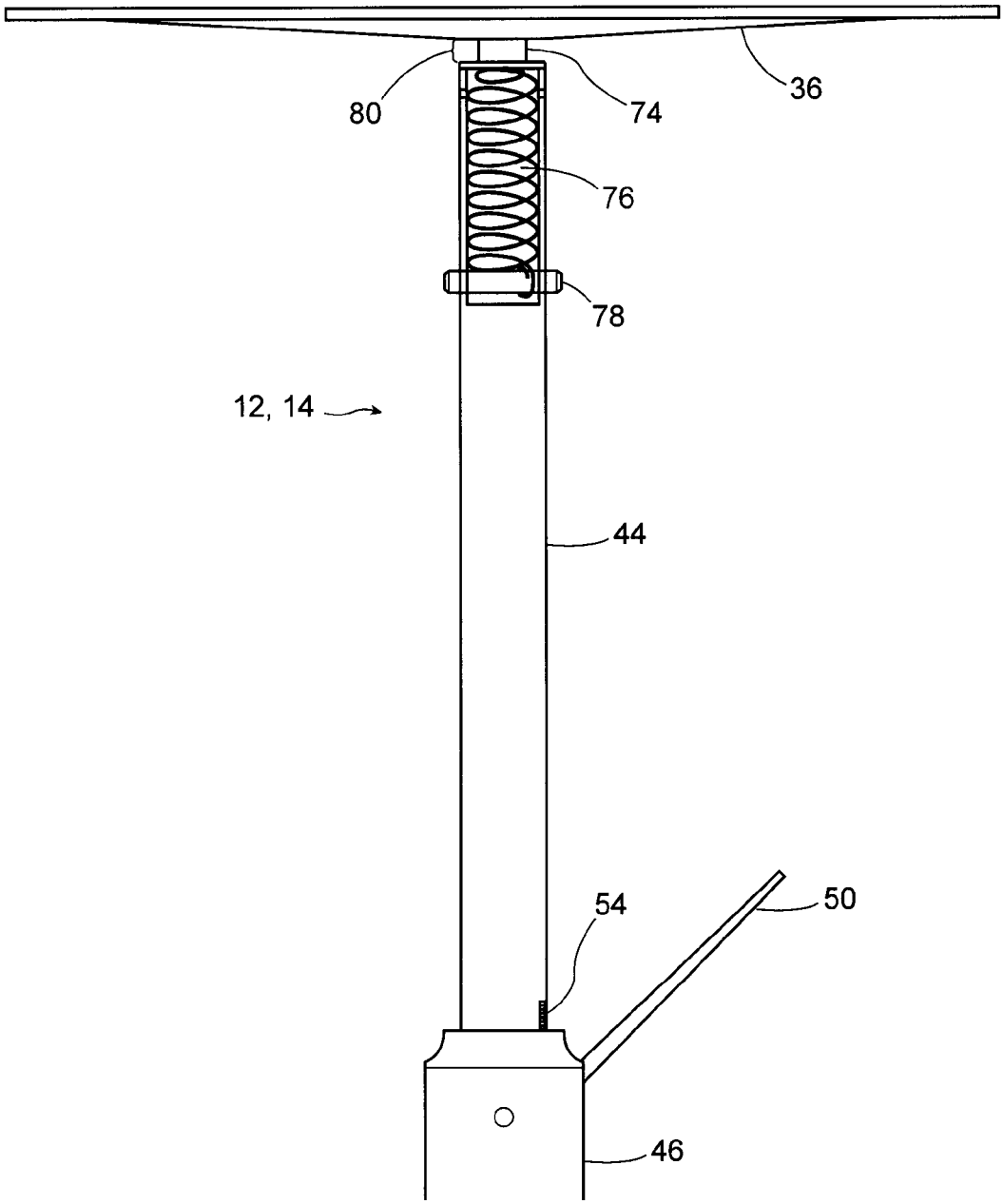
FIG. 5 is an elevation view of a top portion of a support member.

Referring now to FIG. 5, ceiling pad 36 is mounted to shaft 44. Specifically, connecting element 74 extends downward from pad 36 and is connected to a spring member, preferably (but not necessarily) in the form of coil spring 76. Coil spring 76, positioned in the central of shaft 44, is affixed to shaft 44 by means of spring fixing element 78. Preferably, pad 36 has a surface that is at least partly flat to bear on the ceiling to provide force spreading and stability, while not damaging the ceiling.

It can now be appreciated that, with the pad 16 bearing against the floor, a user may lengthen leg 12 or leg 14 by sliding shaft 44 away from shaft 42 to lengthen the support leg so that pad 36 reaches and bears against a ceiling. As the shaft 44 moves upward, and the pad 36 bears on the ceiling, the pad 36 will cease to move upward. However, by means of spring 76 and shaft expansion space 80, shaft 44 can keep moving upward, thus compressing spring 76 between element 74 and element 78. As the spring compresses, it exerts a force upward against element 74 and pad 36, causing pad 36 to bear with force against the ceiling. The compression of the spring 76 also causes the leg to bear with greater force against the floor. The result is that the friction between the leg and floor, and the leg and ceiling, provides improved stability for the frame 10.

It will now be appreciated how the support frame 10 can be assembled. Specifically, the support frame may be assembled so that it bears with force against both the floor and the ceiling, providing additional stability for the frame to permit the patient to be more safely lifted and moved by the patient lift 24.

Typically, the legs 12, 14 would be deployed as described below. The track 20 would then be deployed between legs 12, 14, with the length of track 20 preferably being adjusted to accommodate the distance between the legs. It will be appreciated, however, that the user may choose to assemble the device in a different sequence.

To assemble the legs 12, 14 in place, in the preferred embodiment, the arm 50 is rotated to the disengaged position, which preferably comprises the upward-most extreme of the range of motion of the arm 50. In this position, the teeth 56 of gear 52 are disengaged from teeth 72 of gear section 54. Prior rotating arm 50 to its disengaged position, lock 62 is opened if necessary to permit arm 50 and actuator 48 to move out of its locked position.

The user would then position leg 12 or leg 14 in a generally upright position, with pad 16 bearing against the floor. Having moved actuator 48 to its unlocked position, the user would hold lower shaft 42 with one hand, and upper shaft 44 with the other. The user would then slide the upper shaft upward, lengthening the leg, and bringing the pad 36 to bear against the ceiling. The user would apply as much force as is reasonably possible to push pad 36 against the ceiling, and to compress spring 76 in the process to increase the amount of force with which pad 36 is forced against the ceiling.

It is preferable to apply more compression to spring 76, and therefore, to cause pad 36 to bear against the ceiling with greater force, than is possible by simply pushing shaft 44 upward by hand. Therefore, as will be more particularly described below, mechanical advantage is used to achieve greater compression of spring 76.

It will further be appreciated that, as shaft 44 is being extended upward relative to shaft 42, thus lengthening leg 12 or 14, cam 64 is permitting the extension to take place, as cam 64 preferably locks only against shortening the leg, not extending it. However, cam 64 is biased to lock shafts 44 and 42 against motion that would shorten the leg, and against motion that, in the case being described here, would cause pad 36 to move away from the ceiling. Because cam 64 is biased to this locking position (preferably by being spring loaded), as shaft 44 is extended upward, and as pad 36 bears on the ceiling, the user is protected from shaft 44 and pad 36 falling back down away from the ceiling. Furthermore, as pad 36 reaches the ceiling and the user continues to push upward, the spring 76 is compressed, thus applying downward force against shaft 44. But shaft 44 is locked against downward motion by the cam 64. The cam 64 resists the downward force being applied by the spring, and allows the user to keep pushing shaft 44 upward without having to worry about the spring forcing shaft 44 downward and out of the user's hands.

Once the user has pushed pad 36 against the ceiling with as much force as is conveniently and reasonably possible, the user can let go of shaft 44, and the locking cam 64 will keep shaft 44 from falling down. The user would then begin to rotate arm 50 downward from its disengaged position toward its locking position. As this rotation of arm 50 is executed, near the beginning of the arm 50's range of motion, teeth 56 of gear 52 engage teeth 72 of gear section 54. Teeth 72 of drive gear section 54, and thus shaft 44, move upward relative to shaft 42, the shaft to which actuator 48 is movably fixed, as arm 50 is rotated. As the rotation of arm 50 from its disengaged position through engagement of teeth 56 with gear section 54, down toward the locked position, continues, the shaft 44 is being pushed upward, and spring 76 is compressing further, thus pushing pad 36 to bear with still greater force against the ceiling. Cam 64 continues to lock against gear section 54 and teeth 72, preventing shaft 44 from moving downward in response to the force of spring 76. The use of arm 50 rotating about shaft 58 provides mechanical advantage, thus allowing a user to conveniently and easily compress spring 76 further and push pad 36 harder against the ceiling, notwithstanding that spring 76 is by this time exerting substantial downward force against shaft 44. Once the arm 50 is in its locked position within the recess 60 of sleeve 46, lock 62 is closed to hold arm 50 in place, and provide addition locking (above and beyond the locking of the cam) to ensure that shaft 44 does not come down and pad 36 does not come away from the ceiling. The result is that, with pad 36 bearing against the ceiling, and pad 16 bearing against the floor, with spring 76 supplying a force against both floor and ceiling, the leg 12 or 14 will be firmly held in place by the floor and the ceiling, thus providing stability to frame 10.

The other of the legs 12 and 14 can be assembled in the same manner, and once the track is attached between the two legs, as shown in FIG. 1, the lift 24 can be used safely.

To disassemble the leg 12 or 14, the process is reversed, with some modifications. With the leg deployed and pad 36 bearing against the ceiling, the force compressing spring 76 is being borne by locking cam 64, which locks against the teeth of gear 54. Thus, to remove and disassemble leg 12 or 14, lock 62 is opened. Meanwhile, gear 52 is engaged with gear section 54, arm 50 cannot be rotated to the upward disengaged position, because such motion is locked by cam 64. Selective unlocking of cam 64 allows shaft 44 to move downward without being locked by the cam. To assist in unlocking the cam 64, it is preferable to relieve the force from spring 76 which pushes the cam hard against gear 54. Thus, the user preferably pushes arm 50 inward toward gear 54 (to an unlocking position), which pushes shaft 44 upward a very small amount, taking the load off cam 64 and allowing it to be easily unlocked. It will be appreciated that the arm lock 62 serves to block access to arm 50 while the frame 10 is in use, preventing arm 50 from being pushed to the unlocking position and relieving the pressure on cam 64.

The user can then apply a force to cam actuator 68 through cam access 70, so that the cam pivots about shaft 71, thus moving cam locking portion 66 away from gear section 54 to unlock cam 64. Once this happens, spring 76 would push shaft 44 downward, thus rotating arm 50 toward the disengaged position. The user can move arm 50 to the disengaged position if the movement of shaft 44 caused by the decompression of spring 76 does not do so. It is preferred for the user apply a manual force to arm 50 to keep it from rotating too quickly as shaft 44 moves into shaft 42 to shorten the leg 12 or 14.

Figure 6:
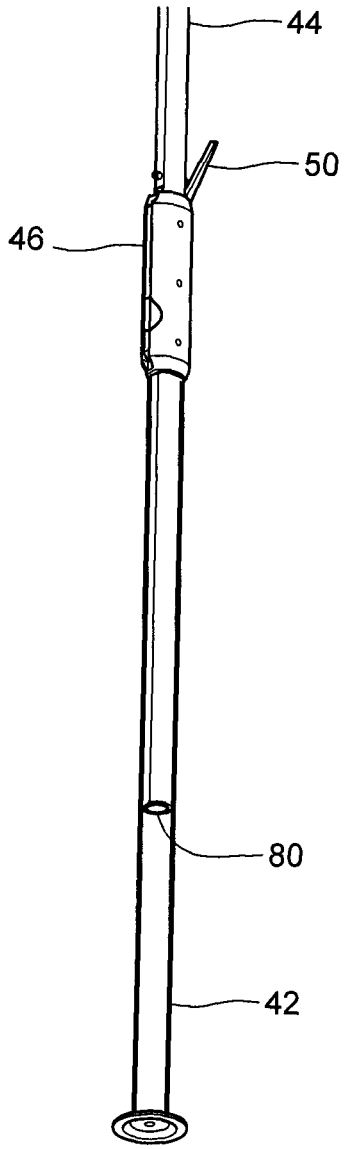
FIG. 6 is a perspective view of a bottom portion of a support member.
Figure 7:
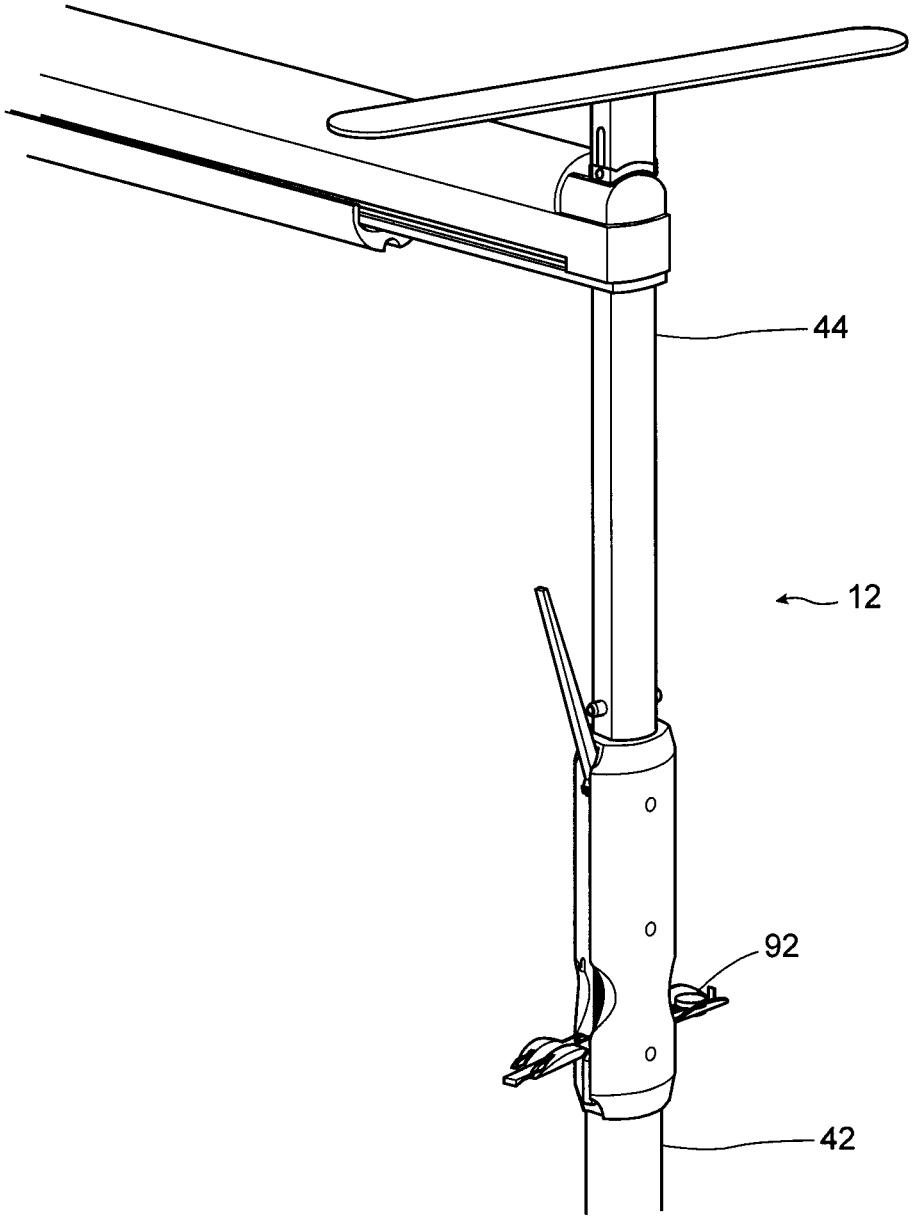
FIG. 7 is a perspective view of the track and its connection to a support member.

The user can then carefully push shaft 44 downward. To reduce the probability that shaft 44 will fall down in an out-of-control manner once cam 64 is unlocked, it is preferable to include a motion speed limiter acting between shafts 44 and 42, to prevent both shafts from moving too quickly relative to one another. Most preferably, this limiter comprises a friction plug 80, as shown in FIG. 6, though other forms of limiter are comprehended. Preferably, the friction plug 80 is positioned at and fixed to the bottom of shaft 44, and is further sized, shaped and positioned to exert a frictional force against the inner surface of shaft 42 as shaft 44 moves up and down through shaft 42. Preferably, the plug 80 is sized and shaped to provide a frictional force so that, without the application of force by hand by a user, shaft 44 will not move relative to shaft 42 when locking cam 64 is disengaged. Rather, to disassemble leg 12 or 14, once cam 64 is disengaged, a user would still preferably have to push shaft 44 downward in order to move pad 36 away from the ceiling.

While it is preferred that both legs 12, 14 bear against both floor and ceiling to provide improved stability, the invention comprehends only one of the legs being configured in that manner, as stability is improved even with this less preferred configuration.

Preferably, the frame includes a visual level indicator 92 on each leg 12, 14. The level indicator 92 comprises a fluid containing a bubble. The indicator is configured so that the bubble will be positioned within a demarcated zone when the leg 12, 14 is vertical. The indicator 92 is preferably positioned on sleeve 46. Indicator 92 preferably is selectively extended from sleeve 46 when in use, but can be retracted to sleeve 46 in a snap fit.

Preferably, the frame 10 includes a pressure indicator 94 to tell the user if the pad 36 is bearing against the ceiling hard enough for adequate stability. In the preferred embodiment, indicator 94 includes a danger region 96 and a safe region 98. It also preferably includes an indicator element 100 whose position in either region 96 or 98 tells the user whether more pressure is needed. Preferably, element 100 is operatively connected to number 76, which determines the size of the force exerted by pad 36 on the ceiling.

It will be appreciated by those skilled in the art that various modifications and alterations to the invention are possible without departing from the broad spirit of the invention as described above and in the appended claims. Some of these were discussed above and others will be apparent. For example, the frame may be made from a variety of different materials or combinations thereof, though lightweight but strong metals, such as aluminum or titanium, are preferred.

The embodiments of the invention in which an exclusive property or privilege is claimed are defined as follows:

1. A patient lift support frame assembly, comprising: a patient-lift-carrying member, and first and second support members for carrying said patient-lift-carrying member, the support members being configured to bear on a floor and support the patient-lift-carrying member above the floor; the first support member comprising a first support element and a second support element slidably engaged with one another such that the length of the first support member is adjusted as the first and second support elements slide relative to each other, one of the first and second support elements being positioned as an upper element of the first support member when the patient lift support frame is assembled, and the other of the first and second support elements being positioned as a lower element when the patient lift support frame is assembled; a driven gear associated with the first support element; a drive gear actuator movably coupled to the second support element and positioned in meshing engagement with the driven gear such that when the actuator is moved, the first and second support elements are urged to slide relative to one another; a lock, movably coupled to the second support element, and engaged with the driven gear, the lock being biased so as to lock against the driven gear to prevent the first and second support elements from sliding so as to shorten the first support member, but configured to permit the first and second support elements to slide so as lengthen the first support member, the lock including an actuator configured to permit the selective unlocking of the lock; a ceiling bearing element, and a spring member, the spring member being fixed to the upper element, the ceiling bearing element being movably mounted to the spring element such that when the ceiling bearing element is pushed against the ceiling, the first support member can move relative to the ceiling bearing element with the ceiling bearing element continuing to bear on the ceiling.

2. The patient lift support frame assembly as claimed in claim 1, wherein the lower element comprises the second support element, and the upper element comprises the first support element.

3. The patient lift support frame assembly as claimed in claim 2, wherein the first and second support elements are arranged and movable in telescopic relation.

4. The patient lift support frame assembly as claimed in claim 3, wherein the second support element comprises a channel for receiving the first support element in telescopic relation, and wherein the first support element is movable within the channel.

5. The patient lift support assembly as claimed in claim 1, wherein the lock comprises a locking cam pivotally mounted to the second support element.

6. The patient lift support assembly as claimed in claim 5, wherein the locking cam is spring loaded to bear against the driven gear.

7. The patient lift support assembly as claimed in claim 4, wherein the driven gear comprises a plurality of driven gear teeth positioned on the surface of the first support element, and extending along a length of the first support element.

8. The patient lift support frame assembly as claimed in claim 4, wherein the drive gear actuator comprises an arm, and a drive gear, the drive gear actuator being pivotally fixed to the second support element.

9. The patient lift support frame assembly as claimed in claim 4, wherein the second support element includes a sleeve portion positioned at a top end of the second support element, the sleeve portion carrying the drive gear actuator and lock.

10. The patient lift support frame assembly as claimed in claim 4, wherein the drive gear actuator is selectively movable to a disengaged position in which the drive gear actuator is disengaged from the driven gear.

11. The patient lift support frame assembly as claimed in claim 4, wherein the ceiling bearing element comprises a force-spreading plate.

12. The patient lift support frame assembly as claimed in claim 1, wherein the first support element includes a floor pad positioned to bear on the floor.

13. The patient lift support frame assembly as claimed in claim 5, wherein the second support element comprises a sleeve positioned at the top end of the second support element, and wherein the cam is mounted to the sleeve.

14. The patient lift support frame assembly as claimed in claim 13, wherein the actuator is mounted to the sleeve.

15. The patient lift support frame assembly as claimed in claim 1, wherein the second support member comprises a third support element and a fourth support element slidably engaged with one another such that the length of the second support member is adjusted as the third and fourth support elements slide relative to each other, one of the third and fourth support elements being positioned as a second upper element of the second support member when the patient-lift-support frame is assembled, and the other of the third and fourth support elements being positioned as a second lower element when the patient-lift-support frame is assembled; a second driven gear associated with the third support element; a second drive gear actuator movably coupled to the fourth support element and positioned in meshing engagement with the second driven gear such that when the second drive gear actuator is moved, the third and fourth support elements are urged to slide relative to one another; a second lock, movably coupled to the fourth support element, and engaged with the second driven gear, the second lock being biased to as to lock against the second driven gear to prevent the third and fourth support elements from sliding so as to shorten the second support member, but configured to permit the third and fourth support elements to slide so as lengthen the second support member, the second lock including a second lock actuator configured to permit the selective unlocking of the second lock.

16. The patient lift support frame assembly as claimed in claim 1, further comprising a second ceiling bearing element, and a second spring member, the second spring member being fixed to the second upper element, the second ceiling bearing element being movably mounted to the second spring element such that when the second ceiling bearing element is pushed against the ceiling, the second support member can move relative to the ceiling bearing element while continuing to bear on the ceiling.

17. The patient lift support frame assembly as claimed in claim 4, wherein the assembly further comprises a visual pressure indicator coupled to the first support member indicating the pressure with which the ceiling bearing element bears on the ceiling when the assembly is in an assembled condition.

18. The patient lift support frame assembly as claimed in claim 4, wherein the assembly further comprises an access blocker, coupled to the first support member, to selectively block access to the drive gear actuator, whereby the movement of the drive gear actuator to an unlocking position is prevented.

19. A patient lift support frame assembly, comprising: a patient-lift-carrying member, and first and second support members for carrying said patient-lift-carrying member, the support members being configured to bear on a floor and support the patient-lift-carrying member above the floor; the first support member comprising a first support element and a second support element slidably engaged with one another such that the length of the first support member is adjusted as the first and second support elements slide relative to each other, one of the first and second support elements being positioned as an upper element of the first support member when the patient lift support frame is assembled, and the other of the first and second support elements being positioned as a lower element when the patient lift support frame is assembled; a driven gear associated with the first support element; a drive gear actuator movably coupled to the second support element and positioned in meshing engagement with the driven gear such that when the actuator is moved, the first and second support elements are urged to slide relative to one another; a lock, movably coupled to the one of the first and second support elements, the lock being selectively lockable to hold the actuator in a locked position with the first support member extended, and selectively openable to allow the actuator to move so that the first support member is shortened; a ceiling bearing element, and a spring member, the spring member being fixed to the upper element, the ceiling bearing element being movably mounted to the spring element such that when the ceiling bearing element is pushed against the ceiling, the first support member can move relative to the ceiling bearing element with the ceiling bearing element continuing to bear on the ceiling.

* * * * *